US010488798B2

(12) United States Patent
Yoshinaga et al.

(10) Patent No.: US 10,488,798 B2
(45) Date of Patent: Nov. 26, 2019

(54) FIXING DEVICE WITH NIP FORMER LONGER THAN OPPOSED ROTATOR

(71) Applicant: Ricoh Company, Ltd., Tokyo (JP)

(72) Inventors: Hiroshi Yoshinaga, Chiba (JP); Ippei Fujimoto, Kanagawa (JP); Kenji Ishii, Kanagawa (JP); Takayuki Seki, Kanagawa (JP); Kazunari Sawada, Shizuoka (JP); Ryohei Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/984,674

(22) Filed: May 21, 2018

(65) Prior Publication Data

US 2018/0356754 A1 Dec. 13, 2018

(30) Foreign Application Priority Data

Jun. 9, 2017 (JP) ..... 2017-114169

(51) Int. Cl.
*G03G 15/20* (2006.01)

(52) U.S. Cl.
CPC ..... *G03G 15/2064* (2013.01); *G03G 15/2053* (2013.01); *G03G 15/206* (2013.01); *G03G 2215/2035* (2013.01)

(58) Field of Classification Search
CPC ..... G03G 15/2064; G03G 15/2053; G03G 15/206; G03G 2215/2016; G03G 2215/2035
See application file for complete search history.

(56) References Cited

U.S. PATENT DOCUMENTS

2007/0292175 A1 12/2007 Shinshi
2013/0177340 A1 7/2013 Kawata et al.
(Continued)

FOREIGN PATENT DOCUMENTS

JP 4-044083 2/1992
JP 2004-286922 10/2004
(Continued)

OTHER PUBLICATIONS

U.S. Appl. No. 15/924,631, filed Mar. 19, 2018 Ippei Fujimoto, et al.
(Continued)

*Primary Examiner* — David M. Gray
*Assistant Examiner* — Laura Roth
(74) *Attorney, Agent, or Firm* — Xsensus LLP

(57) ABSTRACT

A fixing device includes an endless fixing rotator, a heater, a nip formation assembly, and an opposed rotator. The endless fixing rotator is rotatable in a direction of rotation. The heater heats the fixing rotator. The nip formation assembly is disposed opposite an inner circumferential surface of the fixing rotator. The opposed rotator is pressed against the nip formation assembly via the fixing rotator to form a fixing nip between the fixing rotator and the opposed rotator. The nip formation assembly includes a nip former to contact the inner circumferential surface of the fixing rotator, maintain a constant thickness against pressure from the opposed rotator, and transfer heat. The opposed rotator is shorter than the nip former in a longitudinal direction of the opposed rotator. The opposed rotator is disposed within an area opposite the nip former.

7 Claims, 10 Drawing Sheets

(56) References Cited

U.S. PATENT DOCUMENTS

| | | | |
|---|---|---|---|
| 2015/0104227 | A1 | 4/2015 | Shimokawa et al. |
| 2016/0223961 | A1 | 8/2016 | Takagi et al. |
| 2016/0246228 | A1 | 8/2016 | Fujimoto et al. |
| 2016/0274510 | A1 | 9/2016 | Hase et al. |
| 2016/0274511 | A1 | 9/2016 | Ogino et al. |
| 2016/0274514 | A1 | 9/2016 | Ishii et al. |
| 2016/0378027 | A1 | 12/2016 | Sawada et al. |
| 2017/0010570 | A1 | 1/2017 | Fujimoto et al. |
| 2017/0102655 | A1* | 4/2017 | Yamagishi ..... G03G 15/2053 |
| 2017/0176907 | A1 | 6/2017 | Sawada et al. |
| 2017/0185009 | A1 | 6/2017 | Yoshinaga et al. |
| 2017/0185015 | A1 | 6/2017 | Yoshinaga et al. |
| 2017/0185020 | A1 | 6/2017 | Seki et al. |
| 2017/0185021 | A1 | 6/2017 | Seki et al. |
| 2017/0255147 | A1 | 9/2017 | Seki et al. |
| 2017/0261900 | A1 | 9/2017 | Sawada et al. |
| 2017/0364000 | A1 | 12/2017 | Seki et al. |
| 2018/0011432 | A1 | 1/2018 | Yoshinaga et al. |
| 2018/0017910 | A1 | 1/2018 | Sawada et al. |
| 2018/0059587 | A1 | 3/2018 | Sawada et al. |
| 2018/0120741 | A1 | 5/2018 | Yoshinaga et al. |

FOREIGN PATENT DOCUMENTS

| | | |
|---|---|---|
| JP | 2007-334205 | 12/2007 |
| JP | 2010-032625 | 2/2010 |
| JP | 2013-142796 | 7/2013 |
| JP | 2014-174369 | 9/2014 |
| JP | 2015-075695 | 4/2015 |
| JP | 2017-032770 | 2/2017 |

OTHER PUBLICATIONS

U.S. Appl. No. 15/804,459, filed Nov. 6, 2017 Takashi Seto, et al.
U.S. Appl. No. 15/827,085, filed Nov. 30, 2017 Takayuki Seki, et al.

* cited by examiner

FIXING DEVICE WITH NIP FORMER LONGER THAN OPPOSED ROTATOR

CROSS-REFERENCE TO RELATED APPLICATIONS

This patent application is based on and claims priority pursuant to 35 U.S.C. § 119(a) to Japanese Patent Application No. 2017-114169, filed on Jun. 9, 2017, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image on a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

SUMMARY

In one embodiment of the present disclosure, a novel fixing device includes an endless fixing rotator, a heater, a nip formation assembly, and an opposed rotator. The endless fixing rotator is rotatable in a direction of rotation. The heater heats the fixing rotator. The nip formation assembly is disposed opposite an inner circumferential surface of the fixing rotator. The opposed rotator is pressed against the nip formation assembly via the fixing rotator to form a fixing nip between the fixing rotator and the opposed rotator. The nip formation assembly includes a nip former to contact the inner circumferential surface of the fixing rotator, maintain a constant thickness against pressure from the opposed rotator, and transfer heat. The opposed rotator is shorter than the nip former in a longitudinal direction of the opposed rotator. The opposed rotator is disposed within an area opposite the nip former.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
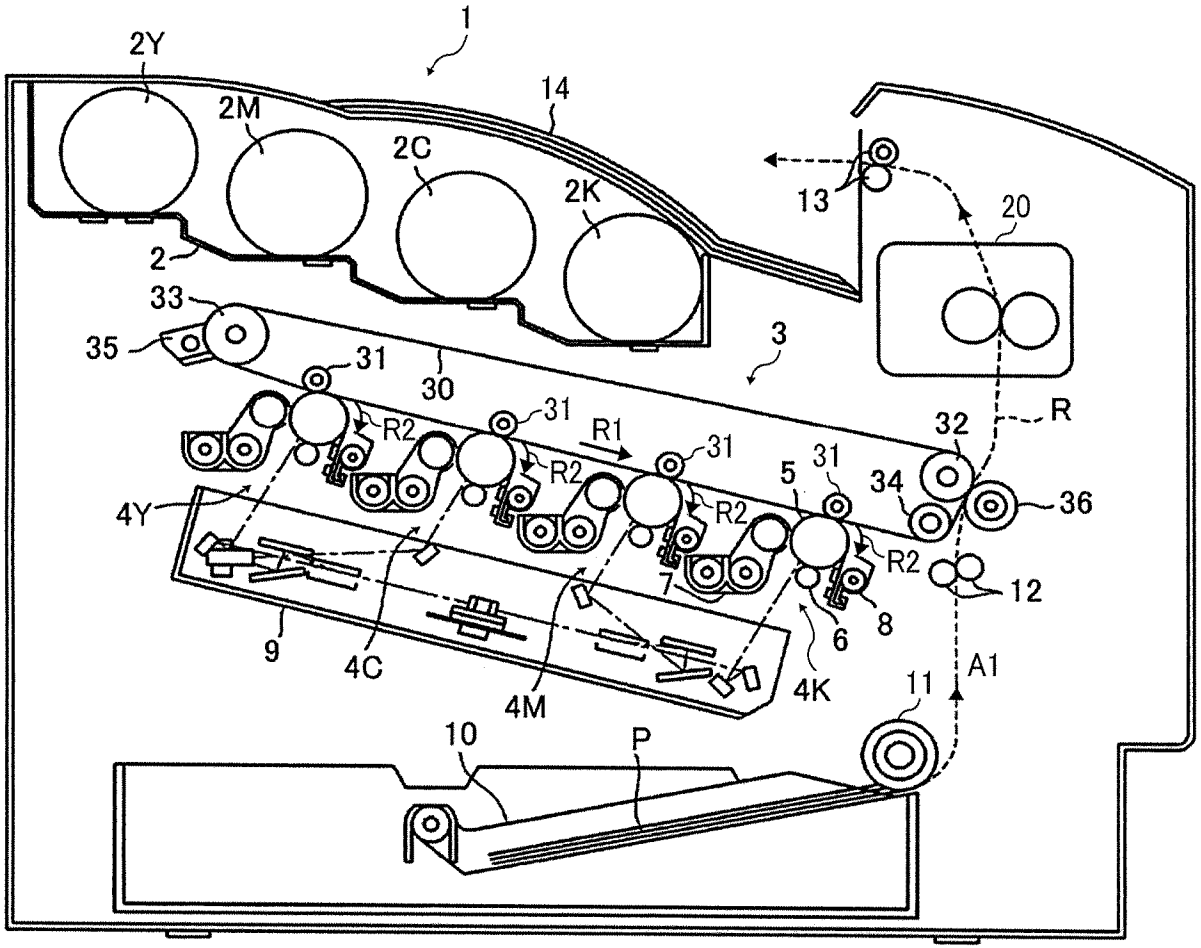
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of an overall configuration of an image forming apparatus 1 according to an embodiment of the present disclosure.

FIG. 1 is a schematic view of the image forming apparatus 1.

The image forming apparatus 1 may be a copier, a facsimile machine, a printer, a multifunction peripheral or a multifunction printer (MFP) having at least two of copying, printing, scanning, facsimile, and plotter functions, or the like.

In the present embodiment, the image forming apparatus 1 is a color laser printer that forms color and monochrome images on recording media by electrophotography. Alternatively, the image forming apparatus 1 may be a monochrome printer that forms a monochrome image on a recording medium. As illustrated in FIG. 1, the image forming apparatus 1 includes, e.g., an intermediate transfer belt 30 and four image forming devices 4Y, 4C, 4M, and 4K. The image forming devices 4Y, 4C, 4M, and 4K are situated in the center of a housing of the image forming apparatus 1, and arranged side by side along a direction in which the intermediate transfer belt 30 is stretched. The image forming devices 4Y, 4C, 4M, and 4K have identical configurations while containing different colors of toner as developers. Specifically, the image forming devices 4Y, 4C, 4M, and 4K contain toner of yellow (Y), cyan (C), magenta (M), and black (K), respectively. The colors yellow, cyan, magenta, and black correspond to color separation components of a color image.

Each of the image forming devices 4Y, 4C, 4M, and 4K is an image station that includes, e.g., a drum-shaped photoconductor 5 as a latent image bearer, a charger 6 that charges the surface of the photoconductor 5, a developing device 7 that supplies toner to an electrostatic latent image formed on the surface of the photoconductor 5, and a cleaner 8 that cleans the surface of the photoconductor 5, as illustrated in the image forming device 4K of FIG. 1, for example.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a counter-clockwise direction of rotation R1 as illustrated in FIG. 1 by friction therebetween.

The four primary transfer rollers 31 sandwich the intermediate transfer belt 30 together with the respective photoconductors 5, thereby forming four primary transfer areas, herein referred to as primary transfer nips, between the intermediate transfer belt 30 and the photoconductors 5. The primary transfer rollers 31 are coupled to a power supply situated inside the image forming apparatus 1. The power supply applies at least one of a predetermined direct current (DC) voltage and a predetermined alternating current (AC) voltage to the primary transfer rollers 31.

The secondary transfer roller 36 sandwiches the intermediate transfer belt 30 together with the secondary transfer backup roller 32, thereby forming a secondary transfer area, herein referred to as a secondary transfer nip, between the secondary transfer roller 36 and the intermediate transfer belt 30. Similar to the primary transfer rollers 31, the secondary transfer roller 36 is coupled to the power supply situated inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A toner receptacle 2 is disposed in an upper portion of the housing of the image forming apparatus 1. The toner receptacle 2 accommodates four removable toner bottles 2Y, 2C, 2M, and 2K that contain fresh toner of the colors yellow, cyan, magenta, and black, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the housing of the image forming apparatus 1 are, e.g., an input tray 10 and a sheet feeding roller 11. The input tray 10 accommodates a plurality of sheets P as recording media. The sheet feeding roller 11 picks up and feeds the plurality of sheets P one at a time from the input tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Optionally, the image forming apparatus 1 may include a bypass feeder that imports such recording media placed on a bypass tray into the housing of the image forming apparatus 1.

In the housing of the image forming apparatus 1 is a conveyance passage R defined by internal components of the image forming apparatus 1. Along the conveyance passage R, the sheet P is conveyed from the input tray 10 to a sheet ejection roller pair 13 via the secondary transfer nip. The sheet ejection roller pair 13 ejects the sheet P outside the housing of the image forming apparatus 1. Along the conveyance passage R are, e.g., a registration roller pair 12, a fixing device 20, and the sheet ejection roller pair 13. The registration roller pair 12 is disposed upstream from the secondary transfer roller 36 in a direction of sheet conveyance (hereinafter referred to as a sheet conveyance direction A1) as a direction of recording medium conveyance. The registration roller pair 12, as a conveyance device, conveys the sheet P to the secondary transfer nip.

The fixing device 20 is disposed downstream from the secondary transfer roller 36 in the sheet conveyance direction A1. The fixing device 20 receives the sheet P bearing a toner image and fixes the toner image onto the sheet P. The sheet ejection roller pair 13 is disposed downstream from the fixing device 20 in the sheet conveyance direction A1. The sheet ejection roller pair 13 ejects the sheet P onto an output tray 14. The output tray 14 is disposed atop the housing of the image forming apparatus 1. The plurality of sheets P ejected by the sheet ejection roller pair 13 lies stacked on the output tray 14 one by one.

In order to provide a fuller understanding of embodiments of the present disclosure, a description is now given of an image forming operation of the image forming apparatus 1 with continued reference to FIG. 1.

When a print job starts, a driver drives and rotates the photoconductor 5 of each of the image forming devices 4Y, 4C, 4M, and 4K in a clockwise direction of rotation R2 as illustrated in FIG. 1. The charger 6 uniformly charges the surface of the photoconductor 5 to a predetermined polarity. The exposure device 9 irradiates the charged surface of the photoconductor 5 with a laser beam to form an electrostatic latent image on the surface of the photoconductor 5 according to image data. Note that the image data is single-color image data obtained by separating a desired full-color image into individual color components, that is, yellow, cyan, magenta, and black components. The developing device 7 supplies toner to the electrostatic latent image thus formed on the surface of the photoconductor 5 to render the electrostatic latent image visible as a toner image.

Meanwhile, when the print job starts, the secondary transfer backup roller 32 is rotated counterclockwise in FIG. 1 to rotate the intermediate transfer belt 30 in the direction of rotation R1. The power supply applies a constant voltage or constant current control voltage having a polarity opposite a polarity of the charged toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches the primary transfer nip in accordance with rotation of the photoconductor 5, the transfer electric field thus generated transfers the toner image from the photoconductor 5 onto the intermediate transfer belt 30. Specifically, toner images of yellow, cyan, magenta, and black are superimposed one atop another while being transferred onto the intermediate transfer belt 30. Thus, a full-color toner image is formed on the surface of the intermediate transfer belt 30. After the primary transfer of the yellow, cyan, magenta, and black toner images from the photoconductors 5 onto the intermediate transfer belt 30, the cleaner 8 removes residual toner from the photoconductor 5. In this case, the residual toner is toner that has failed to be transferred onto the intermediate transfer belt 30 and therefore remains on the photoconductor 5. Then, a discharger discharges the surface of the photoconductor 5 to initialize the surface potential of the photoconductor 5.

In the lower portion of the image forming apparatus 1, the sheet feeding roller 11 starts rotation to feed the sheet P from the input tray 10 toward the registration roller pair 12 along the conveyance passage R. The activation of the registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is supplied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, cyan, magenta, and black constructing the full-color toner image from the intermediate transfer belt 30 onto the sheet P collectively. The belt cleaner 35 removes residual toner from the intermediate transfer belt 30. In this case, the residual toner is toner that has failed to be transferred onto the sheet P and therefore remains on the intermediate transfer belt 30. The removed toner is conveyed and collected into a waste toner container disposed in the housing of the image forming apparatus 1.

The sheet P bearing the full-color toner image is conveyed to the fixing device 20 that fixes the full-color toner image onto the sheet P. Then, the sheet P bearing the fixed full-color toner image is conveyed to the sheet ejection roller pair 13 that ejects the sheet P onto the output tray 14 atop the image forming apparatus 1. Thus, the plurality of sheets P lies stacked on the output tray 14.

As described above, the image forming apparatus 1 forms a full-color image on a recording medium. Alternatively, the image forming apparatus 1 may use one of the image forming devices 4Y, 4C, 4M, and 4K to form a monochrome image. Alternatively, the image forming apparatus 1 may use two of the image forming devices 4Y, 4C, 4M, and 4K to form a bicolor image, or may use three of the image forming devices 4Y, 4C, 4M, and 4K to form a tricolor image.

Figure 2:
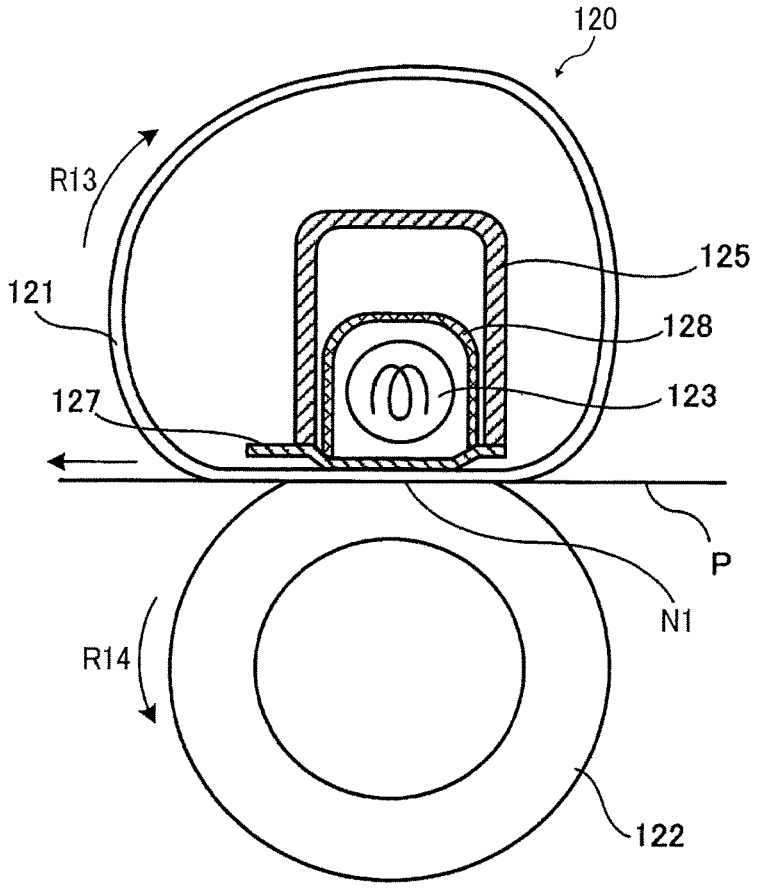
FIG. 2 is a schematic cross-sectional view of a first comparative fixing device.
Figure 3:
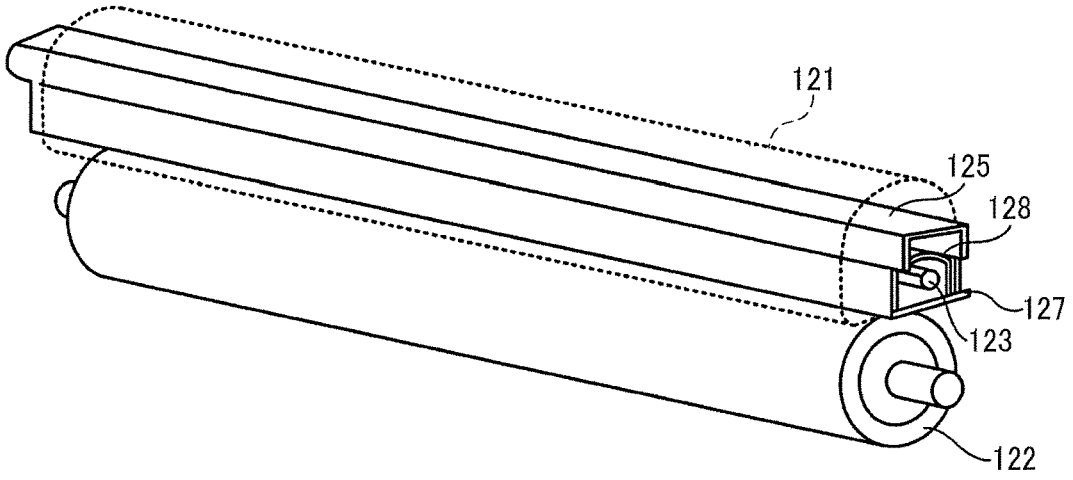
FIG. 3 is a perspective view of the first comparative fixing device of FIG. 2.
Figure 4:
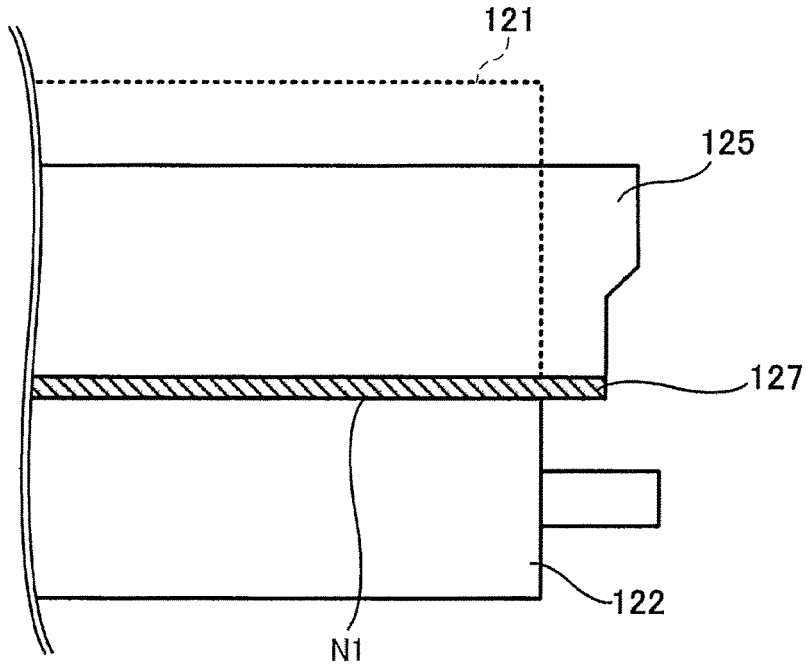
FIG. 4 is a partial side view of the first comparative fixing device of FIG. 3, illustrating the relative positions of end portions of some components in a longitudinal direction thereof.

Referring now to FIGS. 2 through 4, a description is given of a configuration of a first comparative fixing device 120.

FIG. 2 is a schematic cross-sectional view of the first comparative fixing device 120.

The first comparative fixing device 120 includes a fixing belt 121 formed into a loop, a pressure roller 122, and various components disposed inside the loop formed by the fixing belt 121, such as a heater 123, a stay 125, a nip former 127, and a reflector 128. The fixing belt 121 is an endless belt that is a thin, flexible, tubular fixing rotator rotatable in a clockwise direction of rotation R13 as illustrated in FIG. 2. The pressure roller 122 is a pressure rotator that contacts an outer circumferential surface of the fixing belt 121 at an area of contact, herein referred to as a fixing nip N1. The pressure roller 122 is rotatable in a counter-clockwise direction of rotation R14 as illustrated in FIG. 2. The heater 123 is, e.g., a halogen heater, but is not limited thereto. In the present example of FIG. 2, the fixing belt 121 is heated by radiant heat from the heater 123 (e.g., halogen heater) disposed inside the loop formed by the fixing belt 121.

As described above, the stay 125 and the nip former 127 are disposed inside the loop formed by the fixing belt 121 of FIG. 2. The stay 125 secures and supports the nip former 127. The nip former 127 is disposed opposite the pressure roller 122 via the fixing belt 121 to form the fixing nip N1 between the fixing belt 121 and the pressure roller 122. That is, the nip former 127 and the pressure roller 122 sandwich the fixing belt 121 to form the fixing nip N1 between the fixing belt 121 and the pressure roller 122. In the fixing nip N1, heat and pressure sufficient for fixing are applied to the toner image on the sheet P as a recording medium. Thus, the toner image is fixed onto the sheet P.

The nip former 127 is disposed along an axial direction of the fixing belt 121. The stay 125 secures and supports the nip former 127 against the pressure roller 122. Accordingly, even when the nip former 127 receives pressure from the pressure roller 122, the stay 125 prevents the nip former 127 from being bent by such pressure, thereby maintaining a uniform width of the fixing nip N1 along an axial direction of the pressure roller 122, that is, a longitudinal direction of the pressure roller 122. The nip former 127 is preferably made of a material that transfers heat quickly and well, such as copper having a thermal conductivity of 398 W/mk or aluminum having a thermal conductivity of 236 W/mk.

The reflector 128 is interposed between the stay 125 and the heater 123 (e.g., halogen heater). The reflector 128 reflects heat from the heater 123 toward the fixing belt 121 via the nip former 127, thereby enhancing heating efficiency of the heater 123 to heat the fixing belt 121 via the nip former 127. In addition, the reflector 128 prevents radiation heat from the heater 123 from heating the stay 125, thereby suppressing waste of energy.

Opposed end portions of the stay 125 in a longitudinal direction thereof and opposed end portions of the heater 123 in a longitudinal direction thereof are secured to and supported by a pair of side plates of the first comparative fixing device 120 or a pair of holders provided additionally.

FIG. 3 is a perspective view of the first comparative fixing device 120 of FIG. 2. FIG. 4 is a partial side view of the first comparative fixing device 120 of FIG. 3, illustrating the relative positions of end portions of some components in a longitudinal direction thereof.

The nip former 127 is longer than the fixing belt 121 in a longitudinal direction of the nip former 127, that is, the axial direction of the fixing belt 121. Opposed end portions of the nip former 127 are located outside the fixing belt 121 in the longitudinal direction of the nip former 127, that is, the axial direction of the fixing belt 121. Such a configuration prevents the opposed end portions of the nip former 127 in the longitudinal direction thereof from contacting and damaging the fixing belt 121.

Like the nip former 127, the opposed end portions of the stay 125 project outward from the fixing belt 121 in the longitudinal direction of the stay 125, that is, the axial direction of the fixing belt 121. Heat from the heater 123 is conducted outside via the opposed end portions of the nip former 127 and the stay 125 in the longitudinal direction thereof, thereby wasting energy.

Figure 5:
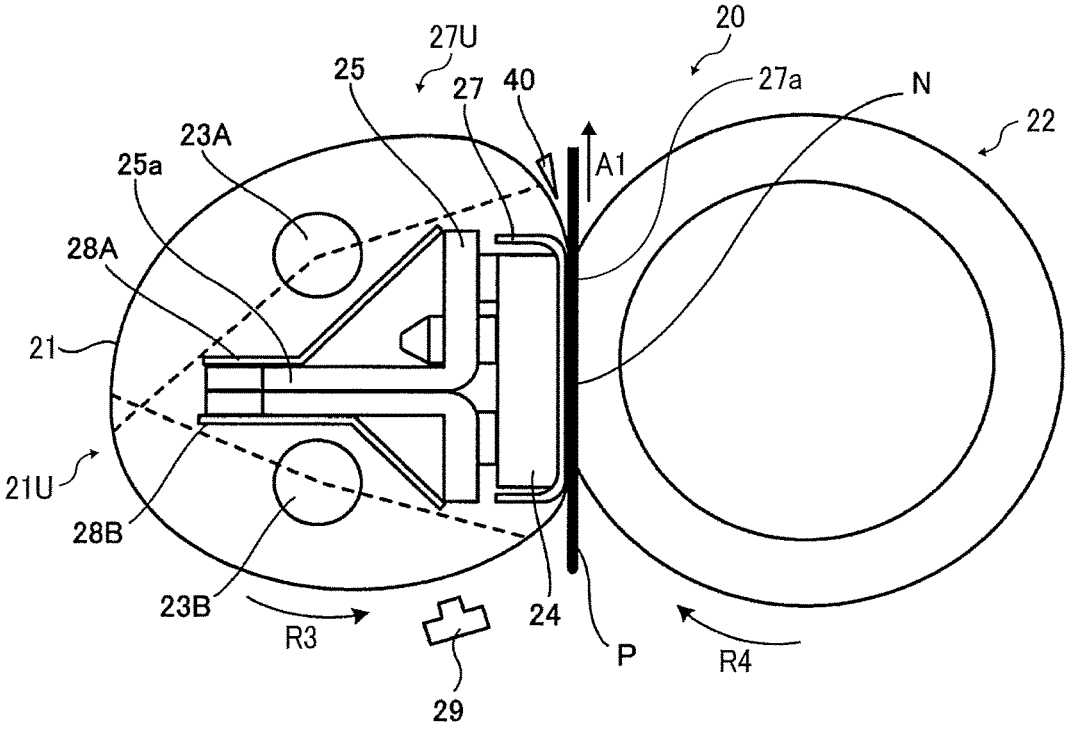
FIG. 5 is a schematic cross-sectional view of a fixing device according to a first embodiment of the present disclosure incorporated in the image forming apparatus of FIG. 1.

Referring now to FIG. 5, a description is given of a fixing device 20 according to a first embodiment of the present disclosure.

FIG. 5 is a schematic cross-sectional view of the fixing device 20 incorporated in the image forming apparatus 1 described above.

The fixing device 20 (e.g., a fuser or a fuser unit) includes, e.g., a fixing belt 21, heaters 23A and 23B, a nip formation assembly 27U, and a pressure roller 22. The fixing belt 21 is an endless fixing rotator rotatable in a direction of rotation R3. The heaters 23A and 23B heat the fixing belt 21. The nip formation assembly 27U is disposed inside a loop formed by the fixing belt 21. In other words, the nip formation assembly 27U is disposed opposite an inner circumferential surface of the fixing belt 21. The pressure roller 22 is an opposed rotator rotatable in a direction of rotation R4. The pressure roller 22 (i.e., opposed rotator) is pressed against the nip formation assembly 27U via the fixing belt 21 to form an area of contact, herein referred to as a fixing nip N, between the fixing belt 21 and the pressure roller 22. As illustrated in FIG. 5, various components are disposed inside the loop formed by the fixing belt 21, such as the heaters 23A and 23B, a base 24, a stay 25, a nip former 27, and reflectors 28A and 28B. The fixing belt 21 and such components disposed inside the loop formed by the fixing belt 21 constitute a belt unit 21U, detachably coupled to the pressure roller 22.

Each of the fixing belt 21 and the pressure roller 22 extends in a longitudinal direction, that is, an axial direction, which is perpendicular to a surface of the paper on which FIG. 5 is drawn. Specifically, each of the fixing belt 21 and the pressure roller 22 extends longer than a width of the sheet P in the axial direction of the fixing belt 21 and the pressure roller 22. The fixing belt 21 and the pressure roller 22 sandwich and convey the sheet P.

The fixing belt 21 is heated by radiation heat from the heaters 23A and 23B disposed inside the loop formed by the fixing belt 21. In the present embodiment, the heaters 23A and 23B are halogen heaters, but is not limited thereto.

As described above, the nip formation assembly 27U is disposed inside the loop formed by the fixing belt 21.

The nip formation assembly 27U includes at least the nip former 27 that contacts the inner circumferential surface of the fixing belt 21. The nip former 27 maintains a constant thickness against pressure from the pressure roller 22. The nip former transfers heat. The nip formation assembly 27U further includes the base 24 and the stay 25 disposed on an opposite side of a belt-side face 27*a* of the nip former 27. Here, the belt-side face 27*a* of the nip former 27 contacts the fixing belt 21 as illustrated in FIG. 5. The stay 25 stiffens the base 24.

Specifically, the base 24 is disposed along the axial direction of the fixing belt 21. The stay 25 secures and supports the base 24 against the pressure roller 22. Accordingly, even when the base 24 receives pressure from the pressure roller 22, the stay 25 prevents the base 24 from being bent by such pressure, thereby maintaining a uniform width of the fixing nip N along an axial direction of the pressure roller 22, that is, a longitudinal direction of the pressure roller 22.

The base 24 is made of a heat-resistant material having good mechanical strength and heatproof not less than about 200° C. and not greater than about 350° C. In particular, the base 24 is preferably made of a heat-resistant resin such as polyimide (PI) or polyether ether ketone (PEEK), or such a heat-resistant resin reinforced with glass fibers. Thus, the base 24 is immune to thermal deformation at temperatures in a fixing temperature range desirable to fix a toner image on a sheet P, thereby retaining the shape of the fixing nip N and quality of the toner image formed on the sheet P.

Opposed end portions of the stay 25 in a longitudinal direction thereof and opposed end portions of the heaters 23A and 23B in a longitudinal direction thereof are secured to and supported by a pair of side plates of the fixing device 20 or a pair of holders provided additionally.

Figure 6A:
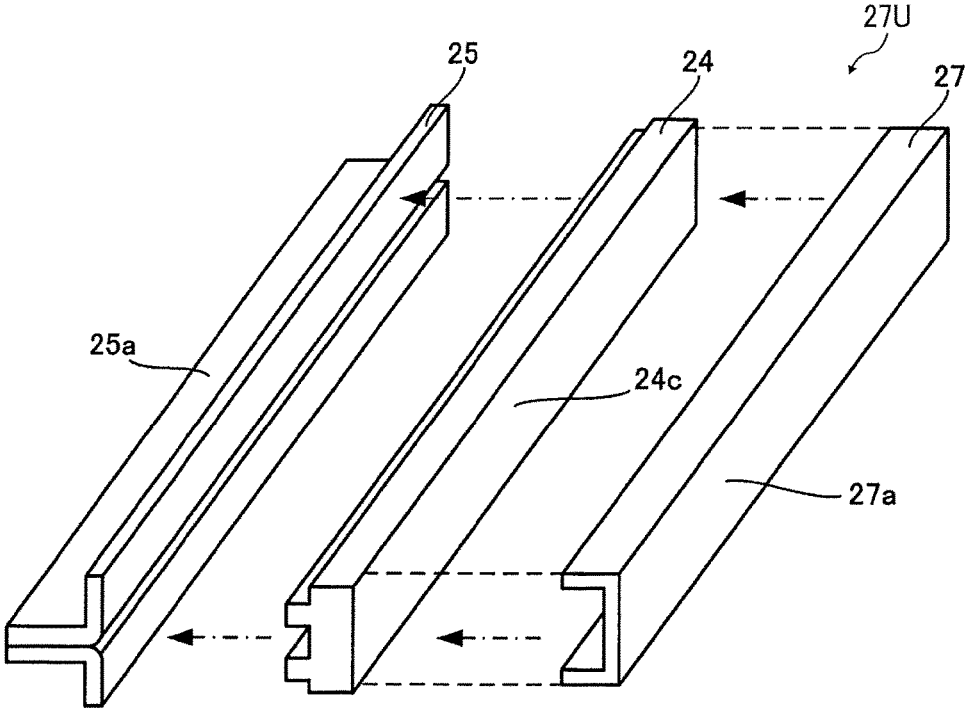
FIG. 6A is an exploded perspective view of a nip formation assembly incorporated in the fixing device of FIG. 5.
Figure 6B:
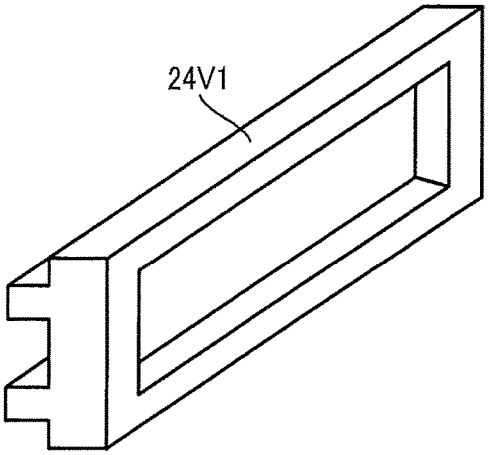
FIG. 6B is a perspective view of a variation of a base incorporated in the nip formation assembly of FIG. 6A.
Figure 6C:
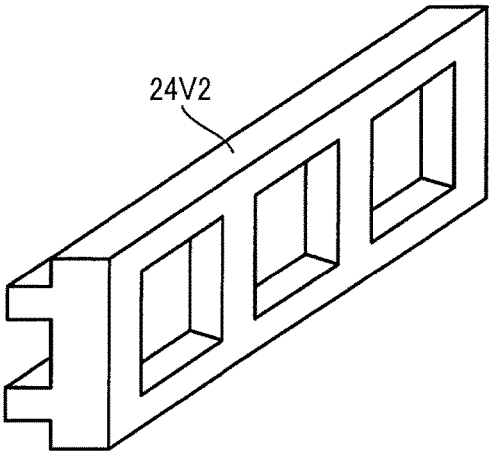
FIG. 6C is a perspective view of another variation of the base incorporated in the nip formation assembly of FIG. 6A.

Referring now to FIGS. 6A through 6C, a description is given of the nip formation assembly 27U.

FIG. 6A is an exploded perspective view of the nip formation assembly 27U. FIG. 6B is a perspective view of a variation of the base 24 incorporated in the nip formation assembly of FIG. 6A. FIG. 6C is a perspective view of another variation of the base 24 incorporated in the nip formation assembly of FIG. 6A.

The nip former 27 is disposed so as to cover the base 24, more specifically, a belt-side face 24*c* of the base 24. The nip former 27 has a thermal equalization function to facilitate heat transfer in the axial direction of the fixing belt 21. Specifically, the nip former 27 transfers and equalizes heat in a longitudinal direction thereof parallel to the axial direction of the fixing belt 21, preventing heat from being stored at opposed end portions of the fixing belt 21 in the axial direction thereof while a plurality of small sheets P is conveyed over the fixing belt 21. Thus, the nip former 27 eliminates uneven heating of the fixing belt 21 in the axial direction thereof. To retain such a thermal equalization function, the nip former 27 is made of a material that transfers heat quickly and well, such as copper having a thermal conductivity of 398 W/mk or aluminum having a thermal conductivity of 236 W/mk.

An enhanced mechanical strength of the base 24 thins the nip former 27 and enhances thermal equalization function of the nip former 27.

In order to reduce heat conduction from the nip former 27, a base 24V1 of FIG. 6B or a base 24V2 of FIG. 6C may be used instead of the base 24. In FIG. 6B, the base 24V1 includes a space apart from the nip former 27. Similarly, in FIG. 6C, the base 24V2 includes a plurality of spaces apart from the nip former 27.

In the present example of FIG. 5, the nip former 27 includes the belt-side face 27*a* being disposed opposite and in direct contact with the inner circumferential surface of the fixing belt 21. Thus, the belt-side face 27*a* serves as a nip formation face. As illustrated in FIG. 6A, the belt-side face 27*a* is flattened, but is not limited to a flat shape. Alternatively, the belt-side face 27*a* may be given a concave shape or another shape. For example, a concave nip formation face directs a leading edge of the sheet P toward the pressure roller 22 as the sheet P is ejected from the fixing nip N, thereby facilitating separation of the sheet P from the fixing belt 21 and preventing a paper jam.

In order to enhance the slidability of the inner circumferential surface of the fixing belt 21 on the nip former 27, a resin material having high slidability may be applied on the surface of the nip former 27 with a thickness of from about 10 μm to about 70 μm, for example.

Further, the surface smoothness or surface roughness of the nip former 27 is determined as appropriate to prevent fracture of the fixing belt 21 over time. Preferably, the coefficient of dynamic friction (μ') is not greater than 0.20μ' between the nip former 27 and the inner circumferential surface of the fixing belt 21. More preferably, the coefficient of dynamic friction is not greater than 0.13μ' or 0.14μ'. Furthermore preferably, the coefficient of dynamic friction is about 0.10μ'. Such a configuration prevents damage to the fixing belt 21 over time. Accordingly, the fixing device 20 exhibits an extended life and an enhanced energy saving.

As illustrated in FIG. 5, a temperature sensor 29 is disposed opposite an outer circumferential surface of the fixing belt 21, that is, outside the loop formed by the fixing belt 21. In the present example, the temperature sensor 29 is disposed upstream from the fixing nip N in the direction of rotation R3 of the fixing belt 21. The temperature sensor 29 detects the temperature of the fixing belt 21.

The separator 40 is disposed downstream from the fixing nip N in the sheet conveyance direction A1 to separate the sheet P from the fixing belt 21.

The fixing belt 21 is an endless belt that is thin like a film and forms a loop of reduced diameter to reduce thermal capacity. Specifically, the fixing belt 21 is constructed of a base layer and a release layer coating the base layer. That is, the base layer and the release layer serve as the inner and outer circumferential surfaces of the fixing belt 21, respectively. The base layer is made of a metal material, such as nickel or stainless steel (e.g., steel use stainless or SUS). Alternatively, the base layer may be made of a resin material such as PI. The release layer is made of, e.g., tetrafluoroethylene-perfluoroalkyl vinyl ether copolymer (PFA) or polytetrafluoroethylene (PTFE).

Optionally, an elastic layer made of rubber such as silicone rubber, silicone rubber foam, or fluororubber may be interposed between the base layer and the release layer. While the fixing belt 21 and the pressure roller 22 pressingly sandwich the unfixed toner image on the sheet P to fix the toner image onto the sheet P, the elastic layer having a thickness of about 100 μM elastically deforms to absorb slight surface asperities in the fixing belt 21, thereby preventing unevenness in gloss of the toner image on the sheet P.

With regard to the thickness of the base layer, the elastic layer, and the release layer of the fixing belt 21, preferably, the base layer has a thickness in a range of from 20 μm to 50 μm. The elastic layer has a thickness in a range of from 100 μm to 300 μm. The release layer has a thickness in a range of from 10 μm to 50 μm.

In order to reduce thermal capacity, the fixing belt 21 preferably has a total thickness not greater than 1 mm and a loop diameter in a range of from 20 mm to 40 mm.

In order to further reduce thermal capacity, preferably, the fixing belt 21 may have a total thickness not greater than 0.2 mm, and more preferably, not greater than 0.16 mm. Preferably, the loop diameter of the fixing belt 21 is not greater than 30 mm.

As illustrated in FIG. 5, the stay 25, having a T-shaped cross-section, includes an arm 25*a* disposed away from the fixing nip N. The arm 25*a* is interposed between the heaters 23A and 23B serving as main heaters, so as to separate the heaters 23A and 23B from each other.

One of the heaters 23A and 23B includes a center heat generator spanning a center of the one of the heaters 23A and 23B in the longitudinal direction thereof to heat toner images on small sheets P passing through the fixing nip N. The other one of the heaters 23A and 23B includes a lateral end heat generator spanning each end portion of the other one of the heaters 23A and 23B in the longitudinal direction thereof to heat toner images on large sheets P passing through the fixing nip N.

The power supply situated inside the image forming apparatus 1 supplies power to the heaters 23A and 23B so that the heaters 23A and 23B generate heat. A controller, operatively connected to the heaters 23A and 23B and the temperature sensor 29, controls the heaters 23A and 23B based on the temperature of the outer circumferential surface of the fixing belt 21, which is detected by the temperature sensor 29 disposed opposite the outer circumferential surface of the fixing belt 21. The controller (e.g., a processor) is a central processing unit (CPU) provided with a random-access memory (RAM) and a read-only memory (ROM), for example. Thus, the fixing belt 21 is heated to a desired fixing temperature by the heaters 23A and 23B controlled as described above.

The reflector 28A is interposed between the stay 25 and the heater 23A. Similarly, the reflector 28B is interposed between the stay 25 and the heater 23B. The reflectors 28A and 28B reflect heat from the heaters 23A and 23B toward the fixing belt 21, thereby enhancing heating efficiency of the heaters 23A and 23B to heat the fixing belt 21. In addition, the reflectors 28A and 28B prevent radiation heat from the heaters 23A and 23B from heating the stay 25, thereby suppressing waste of energy.

Alternatively, instead of the reflectors 28A and 28B, a heater-side face of the stay 25 disposed opposite the heaters 23A and 23B may be insulated or given a mirror finish to enhance heating efficiency of the heaters 23A and 23B and to suppress waste of energy.

Figure 13:
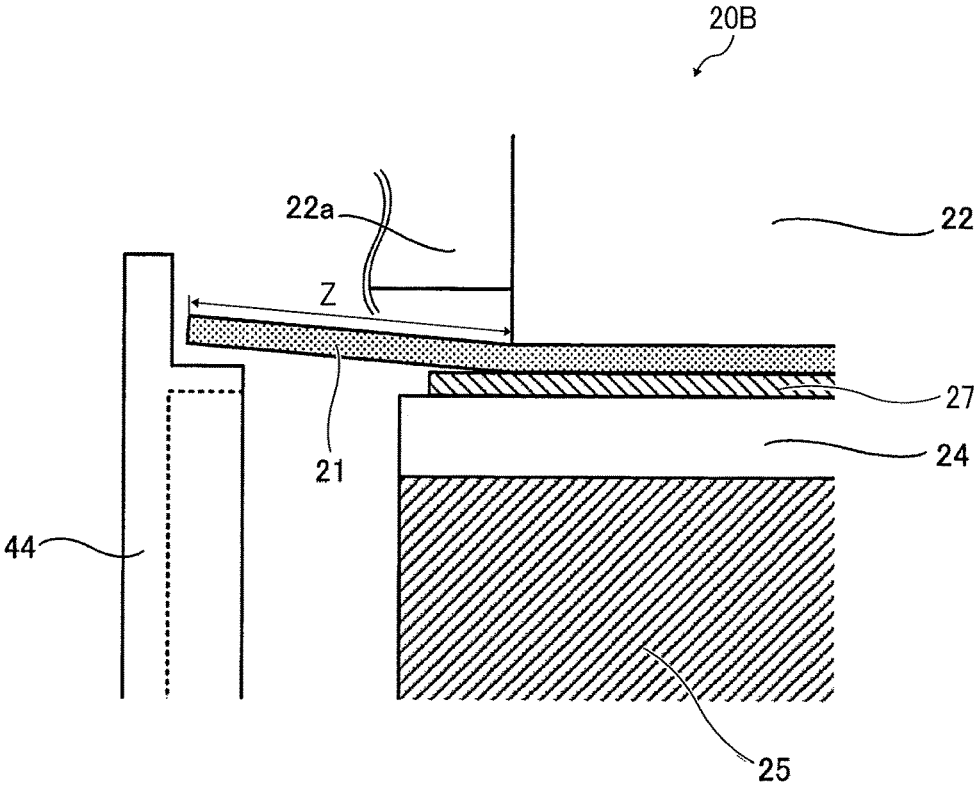
FIG. 13 is a partial side view of an end portion of a fixing device in a longitudinal direction thereof according to a third embodiment of the present disclosure.

The pressure roller 22 is constructed of a core 22*a*, illustrated in FIG. 13, an elastic layer coating the core 22*a*, and a release layer coating the elastic layer. The elastic layer is made of rubber such as silicone rubber foam or fluororubber. The release layer is made of, e.g., PFA or PTFE to facilitate separation of the sheet P from the pressure roller 22.

A presser such as a spring presses the pressure roller 22 against the fixing belt 21. At a portion in pressure contact with the fixing belt 21, the elastic layer of the pressure roller 22 is pressed against the fixing belt 21, thereby forming the fixing nip N having a given width. The presser is preferably capable of both applying pressure and releasing pressure.

In the present embodiment, a driver such as a motor disposed inside the image forming apparatus 1 drives and rotates the pressure roller 22 in the direction of rotation R4. As the driver drives and rotates the pressure roller 22, a driving force of the driver is transmitted from the pressure roller 22 to the fixing belt 21 at the fixing nip N, thereby rotating the fixing belt 21 in the direction of rotation R3. While the fixing belt 21 rotates, a nip span of the fixing belt 21 located at the fixing nip N is sandwiched between the pressure roller 22 and the nip former 27. On the other hand, a circumferential span of the fixing belt 21 other than the nip span is guided by flanges secured to the pair of side plates at the opposed end portions of the fixing belt 21 in the axial direction thereof.

In the present embodiment, the pressure roller 22 is a solid roller. Alternatively, the pressure roller 22 may be a hollow roller, i.e., a tube. If the pressure roller 22 is a hollow roller, optionally, a heater such as a halogen heater may be disposed inside the pressure roller 22. The elastic layer of the pressure roller 22 may be made of solid rubber. Alternatively, if no heater is disposed inside the pressure roller 22, the elastic layer of the pressure roller 22 may be made of sponge rubber. The sponge rubber is preferable to the solid rubber because the sponge rubber has enhanced thermal insulation that draws less heat from the fixing belt 21.

Figure 7:
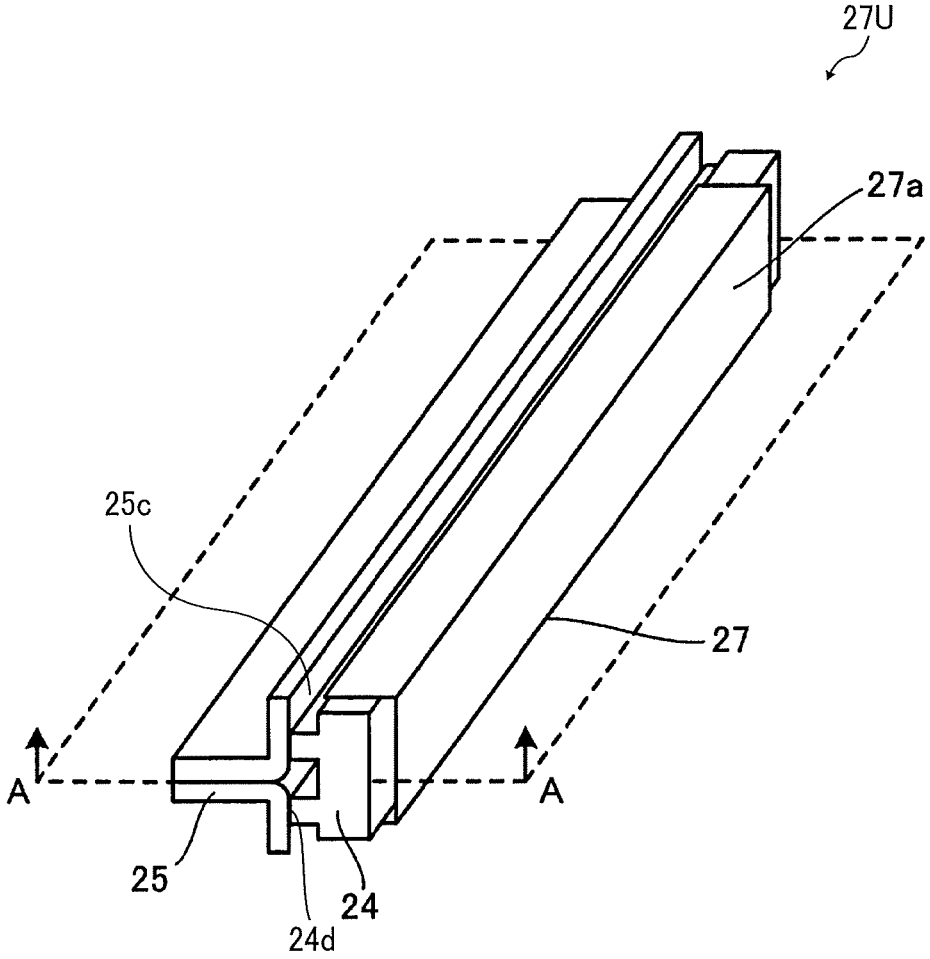
FIG. 7 is a perspective view illustrating a basic, assembled configuration of the nip formation assembly of FIG. 6A.

FIG. 7 is a perspective view illustrating a basic, assembled configuration of the nip formation assembly 27U of FIG. 6A.

As described above, the nip formation assembly 27U includes the base 24, the stay 25, and the nip former 27.

The base 24 includes a stay-side face 24*d* located away from the fixing nip N and on an opposite side of the belt-side face 24*c*. On the other hand, the stay 25 includes a planar belt-side face 25*c* facing the fixing nip N. As illustrated in FIG. 7, the stay-side face 24*d* of the base 24 is coupled to, thus being integrated with, the belt-side face 25*c* of the stay 25. For example, the stay-side face 24*d* of the base 24 and the belt-side face 25*c* of the stay 25 may mount a recess and a projection (e.g., a boss and a pin), respectively, so that the stay-side face 24*d* is engaged with the belt-side face 25*c* to restrict each other to the shapes of the stay-side face 24*d* and the belt-side face 25*c*.

The nip former 27 is engaged with the base 24 given an approximately rectangular shape such that the nip former 27 covers the belt-side face 24*c* that is disposed opposite the inner circumferential surface of the fixing belt 21. Thus, the nip former 27 is integrated with the base 24. For example, the nip former 27 may be engaged with the base 24 with an engaging member (e.g., claw), an adhesive, or the like.

As described above, the nip former 27 includes the belt-side face 27*a* that is disposed opposite the inner circumferential surface of the fixing belt 21. Note that since the belt-side face 24*c* of the base 24 has a mechanical strength greater than that of the belt-side face 27*a* of the nip former 27, the belt-side face 24*c* facing the pressure roller 22 serves as a nip formation face that forms the fixing nip N practically.

Referring now to FIGS. 8A through 9B, a description is given of a second comparative fixing device 220 and a third comparative fixing device 320.

Figure 8A:
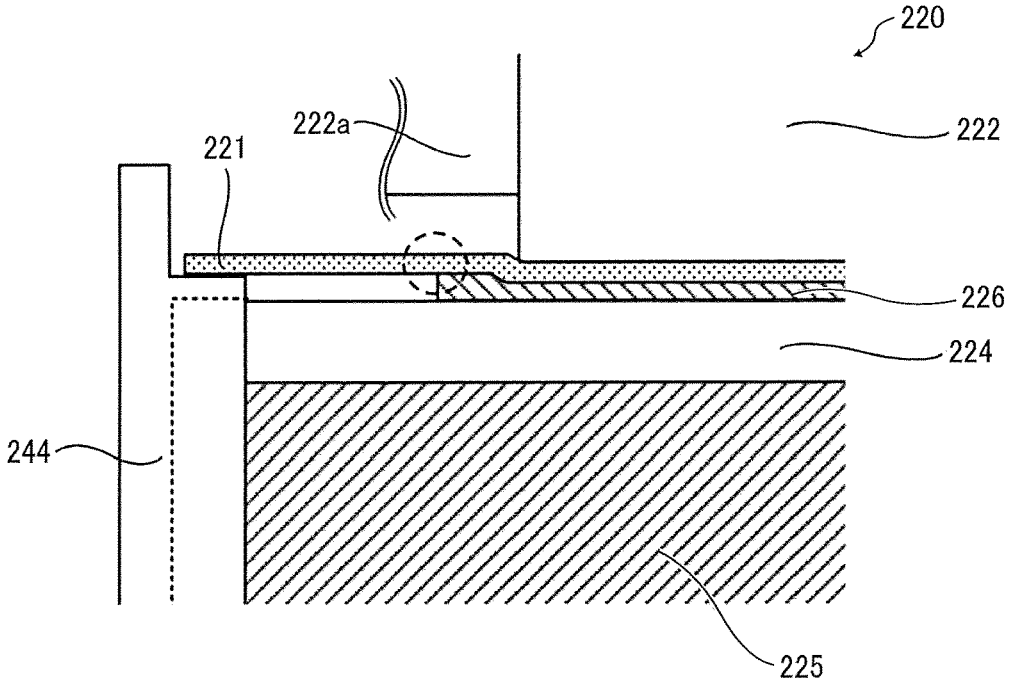
FIG. 8A is a partial side view of a second comparative fixing device, illustrating the relative positions of an end portion of a slide sheet and a fixing belt.
Figure 8B:
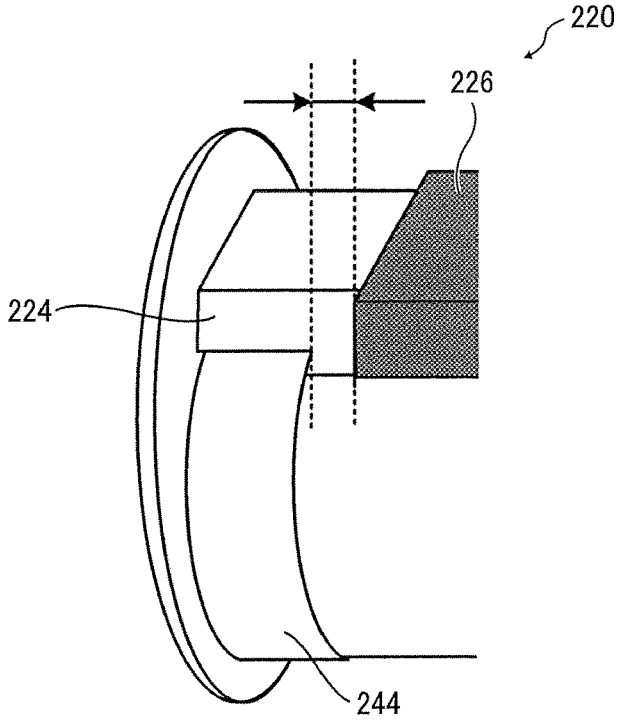
FIG. 8B is a partially enlarged perspective view of the second comparative fixing device of FIG. 8A.
Figure 9A:
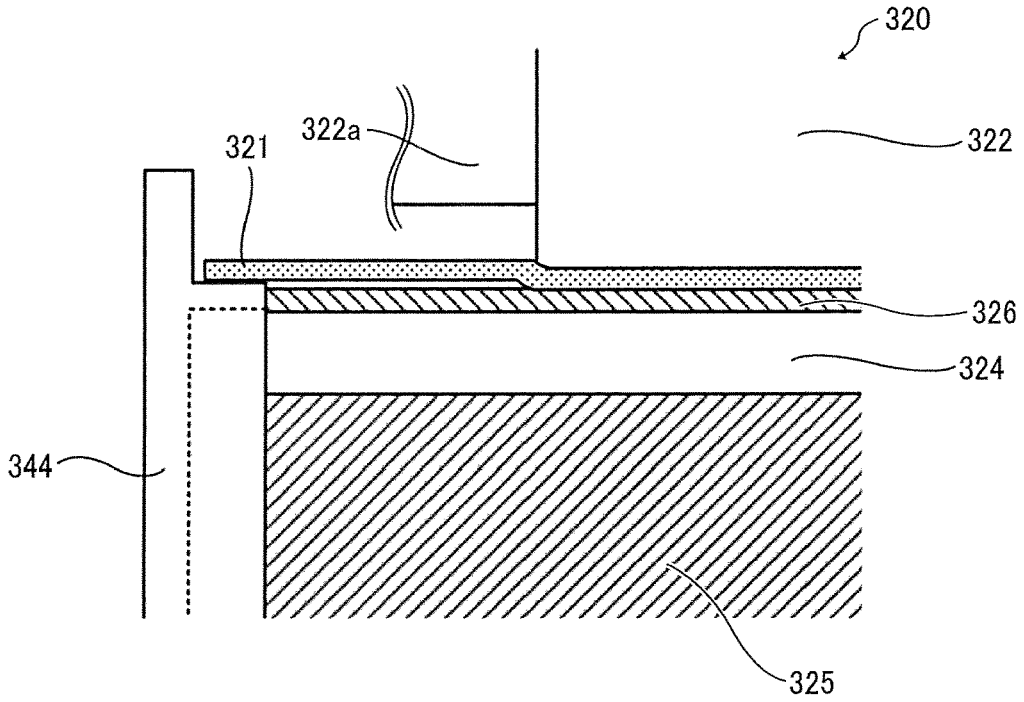
FIG. 9A is a partial side view of a third comparative fixing device, illustrating the relative positions of an end portion of a slide sheet and a fixing belt.
Figure 9B:
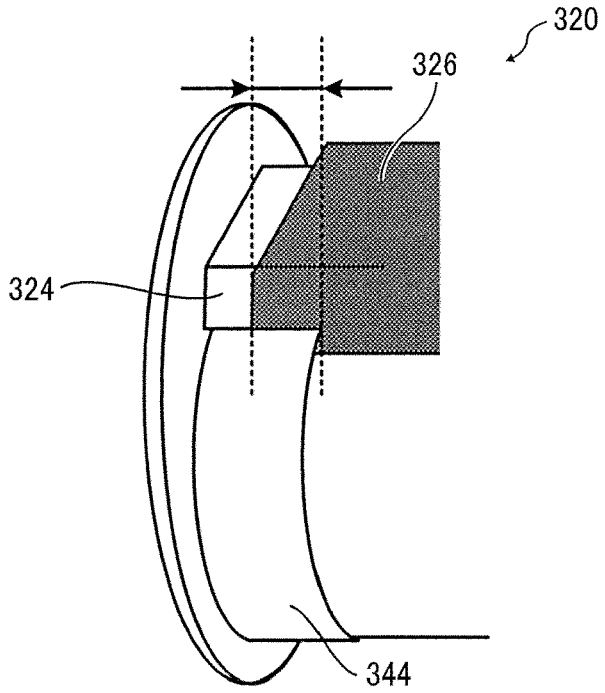
FIG. 9B is a partially enlarged perspective view of the third comparative fixing device of FIG. 9A.

FIG. 8A is a partial side view of the second comparative fixing device 220, illustrating the relative positions of an end portion of a slide sheet 226 and a fixing belt 221. FIG. 8B is a partially enlarged perspective view of the second comparative fixing device 220 of FIG. 8A. FIG. 9A is a partial side view of the third comparative fixing device 320, illustrating the relative positions of an end portion of a slide sheet 326 and a fixing belt 321. FIG. 9B is a partially enlarged perspective view of the third comparative fixing device 320 of FIG. 9A.

As illustrated in FIG. 8A, the second comparative fixing device 220 includes, e.g., the fixing belt 221, a pressure roller 222, a base 224 (e.g., a base pad), a stay 225, the slide sheet 226, and a flange pair 244. The pressure roller 222 includes a core 222*a*. The slide sheet 226 applied with a lubricant is disposed on a belt-side face of the base 224 facing the fixing belt 221 to enhance slidability of the fixing belt 221 over the base 224.

Similarly, as illustrated in FIG. 9A, the third comparative fixing device 320 includes, e.g., the fixing belt 321, a pressure roller 322, a base 324 (e.g., a base pad), a stay 325, the slide sheet 326, and a flange pair 344. The pressure roller 322 includes a core 322*a*. The slide sheet 326 applied with a lubricant is disposed on a belt-side face of the base 324 facing the fixing belt 321 to enhance slidability of the fixing belt 321 over the base 324.

As illustrated in FIGS. 8A and 8B, in order to prevent the lubricant leaking from the slide sheet 226 from contaminating the second comparative fixing device 220, the slide sheet 226 is located inside opposed end portions of the base 224 in a longitudinal direction thereof.

However, compared to the third comparative fixing device 320 illustrated in FIGS. 9A and 9B, each end portion of the slide sheet 226 contacts an inner circumferential surface of the fixing belt 221 as illustrated in a broken circle in FIG. 8A. Each end portion of the slide sheet 226 rubs the fixing belt 221 while the fixing belt 221 rotates, thereby causing damage to the fixing belt 221.

On the other hand, in the third comparative fixing device 320 of FIG. 9A, the slide sheet 326 is disposed to face the vicinity of each end portion of the base 324. Specifically, the slide sheet 326 is disposed so as to partially overlap the flange pair 44. That is, each end portion of the slide sheet 326 does not contact the inner circumferential surface of the fixing belt 321.

Since the slide sheet 326 in which a yarn with high heat resistance is woven in a cloth shape includes voids, pressure from the pressure roller 322 compresses the slide sheet 326, changing the thickness of the slide sheet 326. Specifically, each end portion of the slide sheet 326 that is not pressed by the pressure roller 322 becomes thicker than the pressed portion of the slide sheet 326 and therefore becomes easier to come into contact with the inner circumference of the fixing belt 321. That is, each end portion of the slide sheet 326 may rub the inner circumference of the fixing belt 321 while the fixing belt 321 rotates, thereby causing damage to the fixing belt 321.

To address such a situation, a nip plate made of aluminum may be used as a nip former to maintain a constant thickness against pressure from a pressure roller. However, since such a nip plate has a relatively high thermal conductivity, the nip plate disposed to face each end portion of a fixing belt in an axial direction thereof may conduct heat, which is desired to be conducted to a recording medium at the fixing nip, to another member (e.g., flange pair) coupled to the nip plate, thereby wasting energy.

Hence, in the fixing device 20 according to the present embodiment, a temperature decrease is prevented at the opposed end portions of the fixing belt 21 in the axial direction thereof. In addition, the fixing belt 21 is prevented from being damaged over time due to friction between the fixing belt 21 and the nip former 27. Accordingly, the fixing device 20 exhibits an extended life and an enhanced energy saving.

Referring now to FIGS. 10A through 11B, a description is given of a configuration of the fixing device 20 according to the present embodiment in comparison with a configuration of a fourth comparative fixing device 420.

Figure 10A:
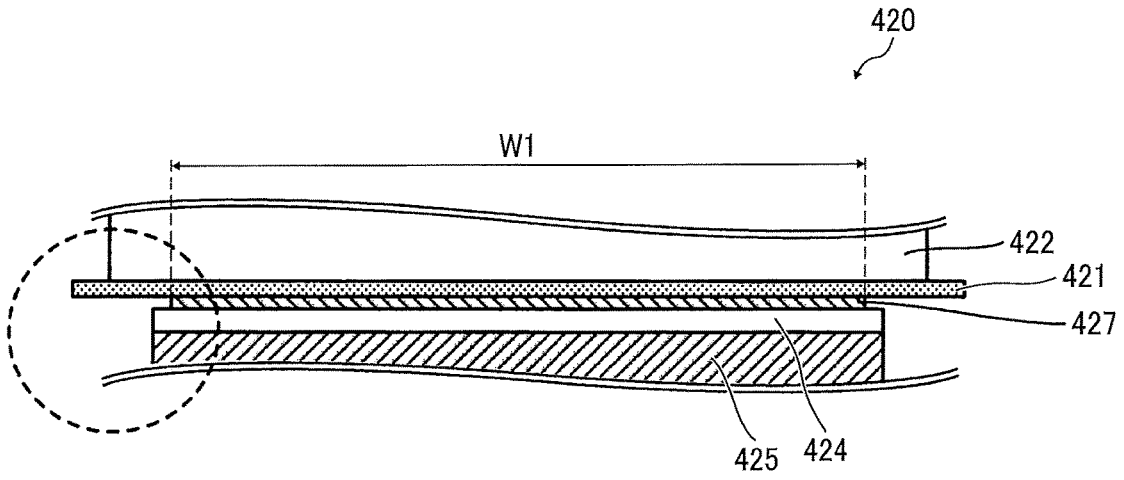
FIG. 10A is a partial side view of a fourth comparative fixing device in a longitudinal direction thereof.
Figure 10B:
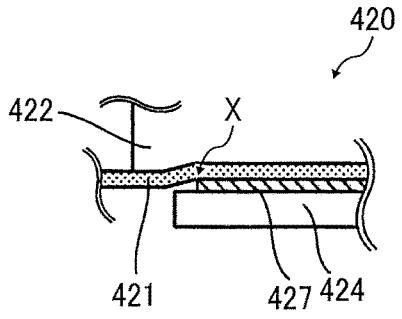
FIG. 10B is a partially enlarged view of an end portion of the fourth comparative fixing device in the longitudinal direction thereof, illustrating the relative positions of a fixing belt, a pressure roller, a nip former, and a base.

Note that FIGS. 10A and 10B illustrate a part of the fourth comparative fixing device 420. The fourth comparative fixing device 420 includes, e.g., a fixing belt 421, a pressure roller 422, a base 424, a stay 425, and a nip former 427. Specifically, FIG. 10A is a partial side view of the fourth comparative fixing device 420 in a longitudinal direction thereof. FIG. 10B is a partially enlarged view of an end portion of the fourth comparative fixing device 420 in the longitudinal direction thereof, illustrating the relative positions of the fixing belt 421, the pressure roller 422, the nip former 427, and the base 424.

Figure 11A:
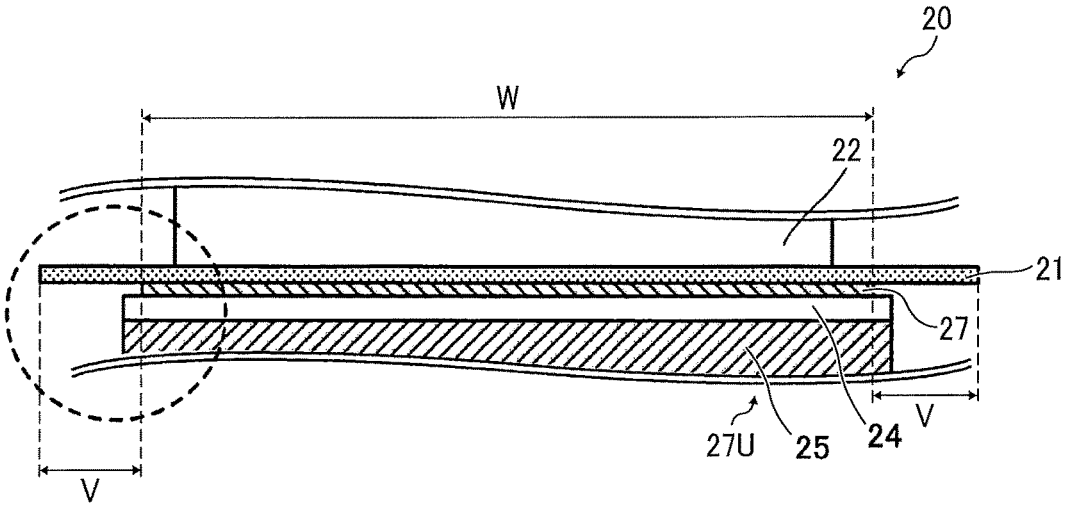
FIG. 11A is a partial side view of the fixing device of FIG. 5 in a longitudinal direction thereof.
Figure 11B:
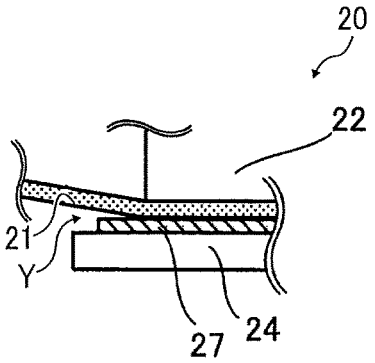
FIG. 11B is a partially enlarged view of an end portion of the fixing device of FIG. 5 in the longitudinal direction thereof, illustrating the relative positions of a fixing belt, a pressure roller, and the nip formation assembly along a line A of FIG. 7.

On the other hand, FIG. 11A is a partial side view of the fixing device 20 according to the present embodiment. FIG. 11B is a partially enlarged view of an end portion of the fixing device 20, illustrating the relative positions of the fixing belt 21, the pressure roller 22, and the nip formation assembly 27U along a line A-A of FIG. 7.

Unlike the fixing device 20 of the present embodiment, the fourth comparative fixing device 420 includes the pressure roller 422 that is longer than the nip former 427 in a longitudinal direction thereof. That is, a part of a nip-formation portion of the pressure roller 422 that contacts the fixing belt 421 does not face the nip former 427 as illustrated in FIG. 10A. In other words, the pressure roller 422 extends beyond an area W1 opposite the nip former 427.

Like the pressure roller 22 of the fixing device 20, the pressure roller 422 includes a core and an elastic layer coating the core. The elastic layer is made of, e.g., silicone rubber foam or fluororubber. Therefore, when the fixing belt 421 is strongly pressed toward the nip former 427, an inner circumferential surface of the fixing belt 421 is strongly pressed against an end portion of the nip former 427 (in particular, a contact portion X) as illustrated in FIG. 10B. By rotating in the state as illustrated in FIG. 10B while being rubbed continuously against the nip former 427, the fixing belt 421 may be damaged and fractured starting from the contact portion X.

By contrast, in the fixing device 20 of the present embodiment, the pressure roller 22 is shorter than the nip former 27 in the longitudinal direction of the pressure roller 22 parallel to the longitudinal direction of the nip former 27. That is, an entire nip-formation portion of the pressure roller 22 that contacts the fixing belt 21 faces the nip former 27 as illustrated in FIG. 11A. In other words, the pressure roller 22 is disposed within an area W opposite the nip former 27 in FIG. 11A.

In this case, the pressure roller 22 does not strongly press the fixing belt 21 against the opposed end portions of the nip former 27 in the longitudinal direction thereof. In addition, since the nip former 27 of the present embodiment maintains a constant thickness against pressure from the pressure roller 22, the opposed end portions of the nip former 27 in the longitudinal direction thereof do not strongly contact the inner circumferential surface of the fixing belt 21. Specifically, as illustrated in FIG. 11B, the fixing belt 21 rotates while the inner circumferential surface thereof does not contact each of the opposed end portions of the nip former 27 (in particular, a portion Y) in the longitudinal direction thereof. Alternatively, the fixing belt 21 may rotate while the inner circumferential surface of the fixing belt 21 slightly contacts each of the opposed end portions of the nip former 27 in the longitudinal direction thereof without being pressed thereagainst. Since the fixing belt 21 is not rubbed while rotating, the fixing belt 21 is not damaged or fractured over time.

In the configuration illustrated in FIGS. 11A and 11B, more specifically, at the fixing nip N, the pressure roller 22 is shorter than the nip former 27 in the longitudinal direction of the pressure roller 22 parallel to the longitudinal direction of the nip former 27. That is, the pressure roller 22 is disposed in the area W opposite the nip former 27 so as not to straddle the opposed end portions of the nip former 27 in the longitudinal direction thereof. Such a configuration prevents friction between the inner circumferential surface of the fixing belt 21 and the opposed end portions of the nip former 27 in the longitudinal direction thereof, thereby further preventing damage to and fracture of the fixing belt 21.

Note that the surface smoothness (i.e., surface roughness) of the nip former 27 is determined as appropriate to prevent fracture over time. The coefficient of dynamic friction between the nip former 27 and the inner circumferential surface of the fixing belt 21 is preferably about 0.10μ'.

Now, a description is given of the relationship between the length of the fixing belt 21 in the axial direction thereof and the length of the nip former 27 in the longitudinal direction thereof parallel to the axial direction of the fixing belt 21.

In the first comparative fixing device 120 described above with reference FIGS. 2 through 4, the end portion of the nip former 127 extends outside the end portion of the fixing belt 121. Therefore, heat is conducted from the end portion of the nip former 127 to a portion other than the fixing nip N1, thus wasting energy.

In order to address such a situation, in the fixing device 20 of the present embodiment illustrated in FIGS. 11A and 11B, the nip former 27 is shorter than the fixing belt 21 in the longitudinal direction of the nip former 27 parallel to the axial direction of the fixing belt 21. The inner circumferential surface of the fixing belt 21 includes a portion V apart from the nip former 27 at each end portion of the inner circumferential surface of the fixing belt 21 in the axial direction thereof.

In the present embodiment, since the base 24 has an enhanced mechanical strength, the nip former 27 is thinner than typical nip formers, thus enhancing thermal equalization function.

Figure 12:
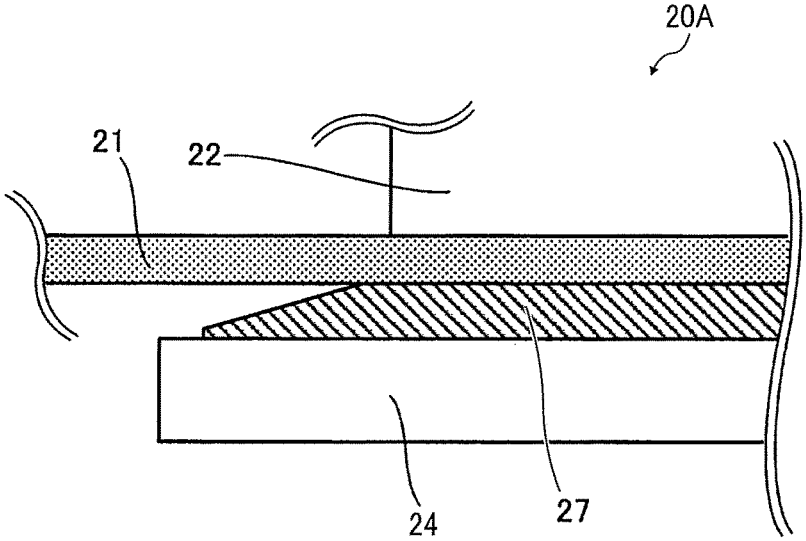
FIG. 12 is a partial side view of an end portion of a fixing device in a longitudinal direction thereof according to a second embodiment of the present disclosure.

Referring now to FIG. 12, a description is given of a fixing device 20A according to a second embodiment of the present disclosure.

FIG. 12 is a partial side view of an end portion of the fixing device 20A in a longitudinal direction thereof.

In the present embodiment, an end portion of the nip former 27 in the longitudinal direction thereof has a thickness gradually decreasing from a center side to an end side. Such a shape of the end portion of the nip former 27 in the longitudinal direction thereof prevents contact and friction between the end portion of the nip former 27 in the longitudinal direction thereof and the inner circumferential surface of the fixing belt 21, thereby reliably preventing damage to and fracture of the fixing belt 21.

Referring now to FIG. 13, a description is given of a fixing device 20B according to a third embodiment of the present disclosure.

FIG. 13 is a partial side view of an end portion of the fixing device 20B in a longitudinal direction thereof.

In the present embodiment, the fixing belt 21 includes an end portion Z apart from the pressure roller 22 in the axial direction thereof. In the end portion Z, the outer circumferential surface of the fixing belt 21 facing the pressure roller 22 is inclined in a direction to approach the pressure roller 22 while the inner circumferential surface of the fixing belt 21 separates from the end portion of the nip former 27 in the longitudinal direction thereof.

Such a configuration is realized by a flange pair 44 serving as a support that supports the fixing belt 21.

In other words, in the present embodiment, the fixing device 20B includes the flange pair 44 serving as a support that supports the opposed end portions of the fixing belt 21 in the axial direction thereof. Specifically, the flange pair 44 supports the fixing belt 21 such that, in the end portion Z, the outer circumferential surface of the fixing belt 21 facing the pressure roller 22 is inclined in a direction to approach the pressure roller 22 while the inner circumferential surface of the fixing belt 21 separates from the end portion of the nip former 27 in the longitudinal direction thereof.

Such a configuration separates the inner circumferential surface of the fixing belt 21 from the end portion of the nip former 27, thereby preventing friction therebetween. Accordingly, such a configuration prevents damage to and fracture of the fixing belt 21.

Note that an excessive pressure contact between the fixing belt 21 and the pressure roller 22 may damage the fixing belt 21 over time. To address such a situation, the amount of movement of the end portion of the fixing belt 21 in the axial direction thereof toward the pressure roller 22 is not greater than 5% of the loop diameter of the fixing belt 21.

According to the embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt or the like may be used as a pressure rotator.

A description is given of advantages of the fixing devices 20, 20A, and 20B according to the embodiments described above.

As illustrated in FIG. 5, a fixing device (e.g., fixing device 20) includes an endless fixing rotator (e.g., fixing belt 21), a heater (e.g., heater 23A), a nip formation assembly (e.g., nip formation assembly 27U), and an opposed rotator (e.g., pressure roller 22). The endless fixing rotator is rotatable in a direction of rotation (e.g., direction of rotation R3). The heater heats the fixing rotator. The nip formation assembly is disposed opposite an inner circumferential surface of the fixing rotator. The opposed rotator is pressed against the nip formation assembly via the fixing rotator to form a fixing nip (e.g., fixing nip N) between the fixing rotator and the opposed rotator. The nip formation assembly includes a nip former (e.g., nip former 27) to contact the inner circumferential surface of the fixing rotator, maintain a constant thickness against pressure from the opposed rotator, and transfer heat. The opposed rotator is shorter than the nip former in a longitudinal direction of the opposed rotator. The opposed rotator is disposed within an area (e.g., area W) opposite the nip former.

Accordingly, a temperature decrease is prevented at opposed end portions of the fixing rotator in an axial direction thereof. The fixing device prevents damage to the fixing rotator due to friction between the fixing rotator and the nip former that forms the fixing nip. Accordingly, the fixing device exhibits an extended life and an enhanced energy saving.

Consequently, an image forming apparatus incorporating such a fixing device also exhibits an extended life and an enhanced energy saving.

Such an image forming apparatus is not limited to a color laser printer illustrated in FIG. 1. Alternatively, the image forming apparatus may be a monochrome laser printer, another type of printer, a copier, a facsimile machine, an MFP, or the like.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure.

What is claimed is:

1. A fixing device, comprising:

an endless fixing rotator rotatable in a direction of rotation;

a heater to heat the fixing rotator;

a nip formation assembly disposed opposite an inner circumferential surface of the fixing rotator; and an opposed rotator press against the nip formation assembly via the fixing rotator to form a fixing nip between the fixing rotator and the opposed rotator, wherein the nip formation assembly includes a nip former to contact the inner circumferential surface of the fixing rotator, maintain a constant thickness against pressure from the opposed rotator, and transfer heat, the opposed rotator is shorter than the nip former in a longitudinal direction of the opposed rotator, the opposed rotator is disposed within an area opposite the nip former; and the fixing rotator includes an end portion, the end portion having a first end that starts from an end of the opposed rotator and extends in an axial direction of the fixing rotator, and in the end portion of the fixing rotator extending from the end of the opposed rotator to an end of the nip former, the nip former has a uniform thickness and an outer circumferential surface of the fixing rotator facing the opposed rotator is inclined in a direction to approach the opposed rotator to cause the inner circumferential surface of the first end of the end portion of the fixing rotator to be separated from and not press against an end portion of the nip former, the end portion of the nip former being in a longitudinal direction of the nip former.

2. The fixing device according to claim 1, wherein the nip former is shorter than the fixing rotator in a longitudinal direction of the nip former, and wherein the inner circumferential surface of the fixing rotator includes a portion apart from the nip former at each end portion of the inner circumferential surface of the fixing rotator in an axial direction of the fixing rotator.

3. The fixing device according to claim 1, wherein the nip formation assembly further includes a base and a stay disposed on an opposite side of a belt-side face of the nip former, the belt-side face of the nip former contacting the fixing rotator, and wherein the stay stiffens the base.

4. The fixing device according to claim 1, further comprising a support to support the end portion of the fixing rotator.

5. The fixing device of claim 1, wherein the fixing rotator is longer in the axial direction than the nip former and the opposed rotator.

6. The fixing device of claim 1, wherein an amount of movement of the end portion of the fixing rotator toward the opposed rotator is not greater than 5% of a loop diameter of the fixing rotator.

7. An image forming apparatus, comprising:

an image forming device to form a toner image; and a fixing device to fix the toner image on a recording medium, the fixing device including:

an endless fixing rotator rotatable in a direction of rotation;

a heater to heat the fixing rotator;

a nip formation assembly disposed opposite an inner circumferential surface of the fixing rotator; and an opposed rotator pressed against the nip formation assembly via the fixing rotator to form a fixing nip between the fixing rotator and the opposed rotator, the nip formation assembly includes at least a nip former to contact the inner circumferential surface of the fixing rotator, maintain a constant thickness against pressure from the opposed rotator, and transfer heat, the opposed rotator is shorter than the nip former in a longitudinal direction of the opposed rotator, the opposed rotator is disposed within an area opposite the nip former; and the fixing rotator includes an end portion, the end portion having a first end that starts from an end of the opposed rotator and extends in an axial direction of the fixing rotator, and in the end portion of the fixing rotator extending from the end of the opposed rotator to an end of the nip former, the nip former has a uniform thickness and an outer circumferential surface of the fixing rotator facing the opposed rotator is inclined in a direction to approach the opposed rotator to cause the inner circumferential surface of the first end of the end portion of the fixing rotator to be separated from and not press against an end portion of the nip former, the end portion of the nip former being in a longitudinal direction of the nip former.

* * * * *